US006234625B1

(12) United States Patent
Wen

(10) Patent No.: US 6,234,625 B1
(45) Date of Patent: May 22, 2001

(54) PRINTING APPARATUS WITH RECEIVER TREATMENT

(75) Inventor: Xin Wen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/105,743

(22) Filed: Jun. 26, 1998

(51) Int. Cl.[7] ..... B41J 2/01

(52) U.S. Cl. ..... 347/101; 347/96; 347/103; 347/105

(58) Field of Search ..... 347/101, 103, 347/105, 96; 101/3.1; 492/16, 17, 18

(56) References Cited

U.S. PATENT DOCUMENTS

| | | | | |
|---|---|---|---|---|
| 4,382,262 | * | 5/1983 | Savit | 346/1.1 |
| 4,694,302 | | 9/1987 | Hackleman et al. | 346/1.1 |
| 5,232,499 | | 8/1993 | Kato et al. | 118/244 |
| 5,482,552 | | 1/1996 | Kikukawa et al. | 118/264 |
| 5,598,196 | | 1/1997 | Braun | 347/68 |
| 5,611,847 | | 3/1997 | Guistina et al. | 106/20 R |
| 5,635,969 | | 6/1997 | Allen | 347/96 |
| 5,640,187 | | 6/1997 | Kashiwazaki et al. | 347/101 |
| 5,679,139 | | 10/1997 | McInerney et al. | 106/20 D |
| 5,679,141 | | 10/1997 | McInerney et al. | 106/20 D |
| 5,679,142 | | 10/1997 | McInerney et al. | 106/20 D |
| 5,698,018 | | 12/1997 | Bishop et al. | 106/31.75 |
| 6,010,590 | * | 1/2000 | Cherkas | 347/105 X |

FOREIGN PATENT DOCUMENTS

776950 A2 11/1996 (EP) .

* cited by examiner

*Primary Examiner*—John S. Hilten
*Assistant Examiner*—Minh H. Chau
(74) *Attorney, Agent, or Firm*—Raymond L. Owens

(57) ABSTRACT

Apparatus for forming a colorant image with improved image structure on a receiver in response to a digital image, including ink jet print heads responsive to the digital image for transferring colorant to the receiver; a passive fluid delivering structure for delivering treatment fluid to the receiver, the treatment fluid being selected to improve image structure; and relative movement is provided between the receiver and the ink jet print heads so that colorant is transferred to the receiver to provide the colorant image corresponding to the digital image on the receiver which has improved image structure.

5 Claims, 3 Drawing Sheets

PRINTING APPARATUS WITH RECEIVER TREATMENT

CROSS REFERENCE TO RELATED APPLICATIONS

Reference is made to commonly assigned U.S. patent application Ser. No. 08/934,370, filed Sep. 19, 1997 entitled "Ink Jet Printing with Radiation Treatment" to Wen. The disclosure of this related application is incorporated herein by reference.

FIELD OF THE INVENTION

The present invention relates to methods and apparatus for providing a high quality colorant images on a receiver.

BACKGROUND OF THE INVENTION

To enhance the quality of the images printed by an ink jet printer, it is often desirable to treat the surface of the ink receiver with a fluid prior to ink jet printing. For example, U.S. Pat. No. 5,635,969 discloses a print head that preconditions the ink receiver with a treatment fluid that immobilizes the ink spots printed on the receiver. This technique, however, requires electrically driving the print head to deliver the treatment fluid to the ink receiver. The technique consumes power and its reliability can also be affected by the failure of the fluid chambers and nozzles in the print head.

SUMMARY OF THE INVENTION

An object of this invention is to provide a printing apparatus including capability of treating the receiver for enhanced image structure.

A further object of this invention is to provide receiver treatment without requiring the use of power during the treatment.

An additional object of the present invention is to provide receiver treatment that is reliable.

These objects are achieved by apparatus for forming a colorant image with improved image structure on a receiver in response to a digital image, comprising:

a) print head means responsive to the digital image for transferring colorant to the receiver;

b) passive fluid delivering means for delivering treatment fluid to the receiver, the treatment fluid being selected to improve image structure; and c) means for providing relative movement between the receiver and the print head means so that colorant is transferred to the receiver to provide the colorant image corresponding to the digital image on the receiver which has improved image structure.

ADVANTAGES

An advantage of this invention is that the power is reduced for producing an image on a receiver.

Another advantage of this invention is that the reliability of the receiver treatment is improved.

A further advantage of this invention is that different treatment fluids can be selected which are compatible with improving different aspects of image structure.

DETAILED DESCRIPTION OF THE INVENTION

The present invention is described with relation to a digital printing apparatus including the treatment the receiver for enhanced image structure.

Figure 1:
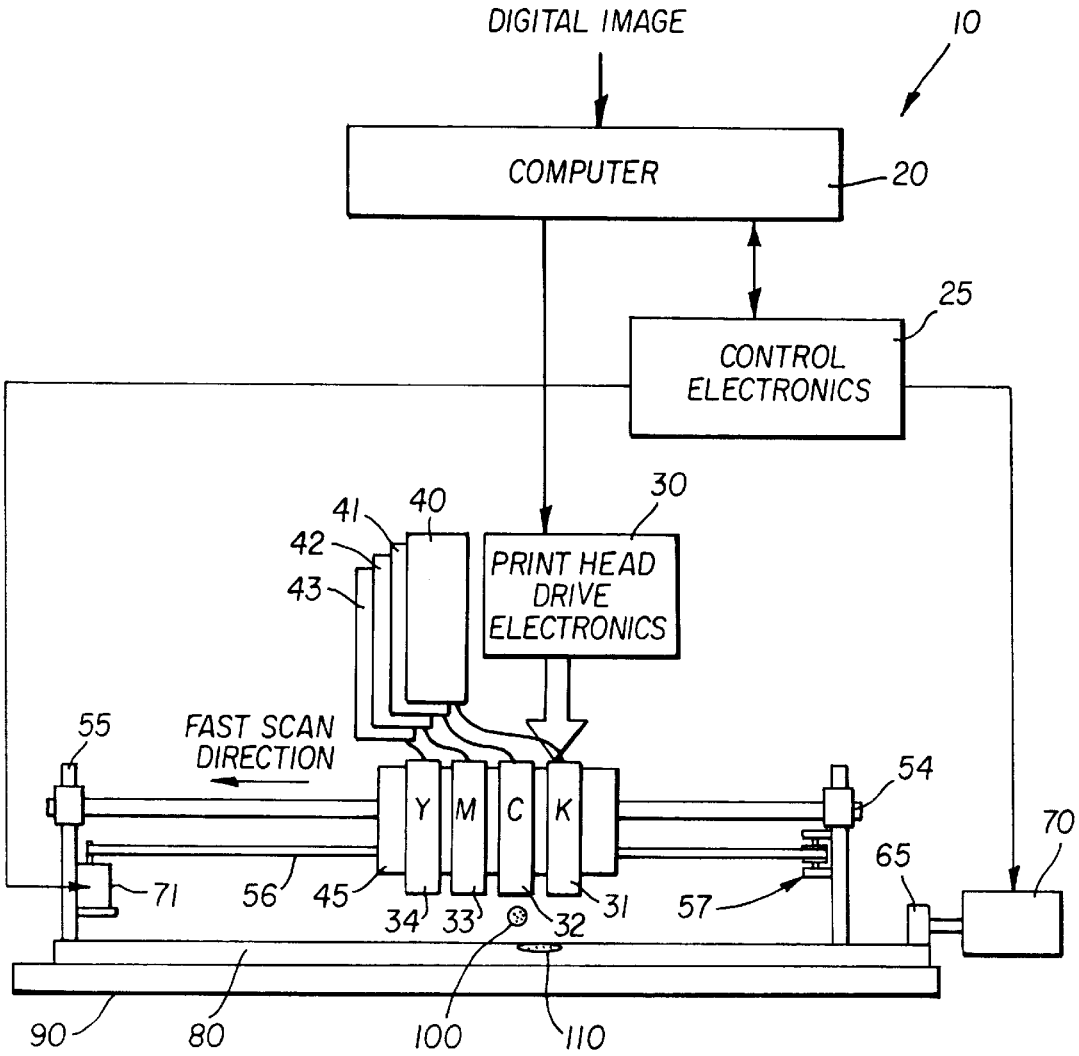
FIG. 1 is a schematic front view of the ink jet printing apparatus in the present invention diagramatically showing the control electronics.

Referring to FIG. 1, an ink jet printing apparatus 10 is shown to comprise a computer 20, control electronics 25, print head drive electronics 30, ink jet print head 31–34 respectively for printing black ink (K), cyan ink (C), magenta ink (M), and yellow ink (Y), a plurality of ink reservoirs 40–43 for providing the color inks to the print heads 31–34. Throughout the specification and claims, the term "colorant" will be understood to include inks such as pigmented or dye based materials. The ink jet printing apparatus 10 further includes a receiver transport motor 70 and a roller 65 for transporting an ink receiver 80 across a platen 90 past the ink jet print heads 31–34. The print heads 31–34 are fixed to a holder 45. The print heads 31–34 and the holder 45 are translated by a belt 56, a pulley mechanism 57, and a print head translating motor 71 along the gliding rail 54 in the fast scan direction (as indicated in FIG. 1). The gliding rail is supported by supports 55. The print heads 31–34 can take various forms known in the art, for example, piezoelectric or thermal ink jet print head. An example of such a print head is shown in commonly assigned U.S. Pat. No. 5,598,196. The inks stored in the reservoirs 40–43 are supplied to the print heads 31–34, respectively. The receiver 80 is supported by the platen 90.

Figure 2:
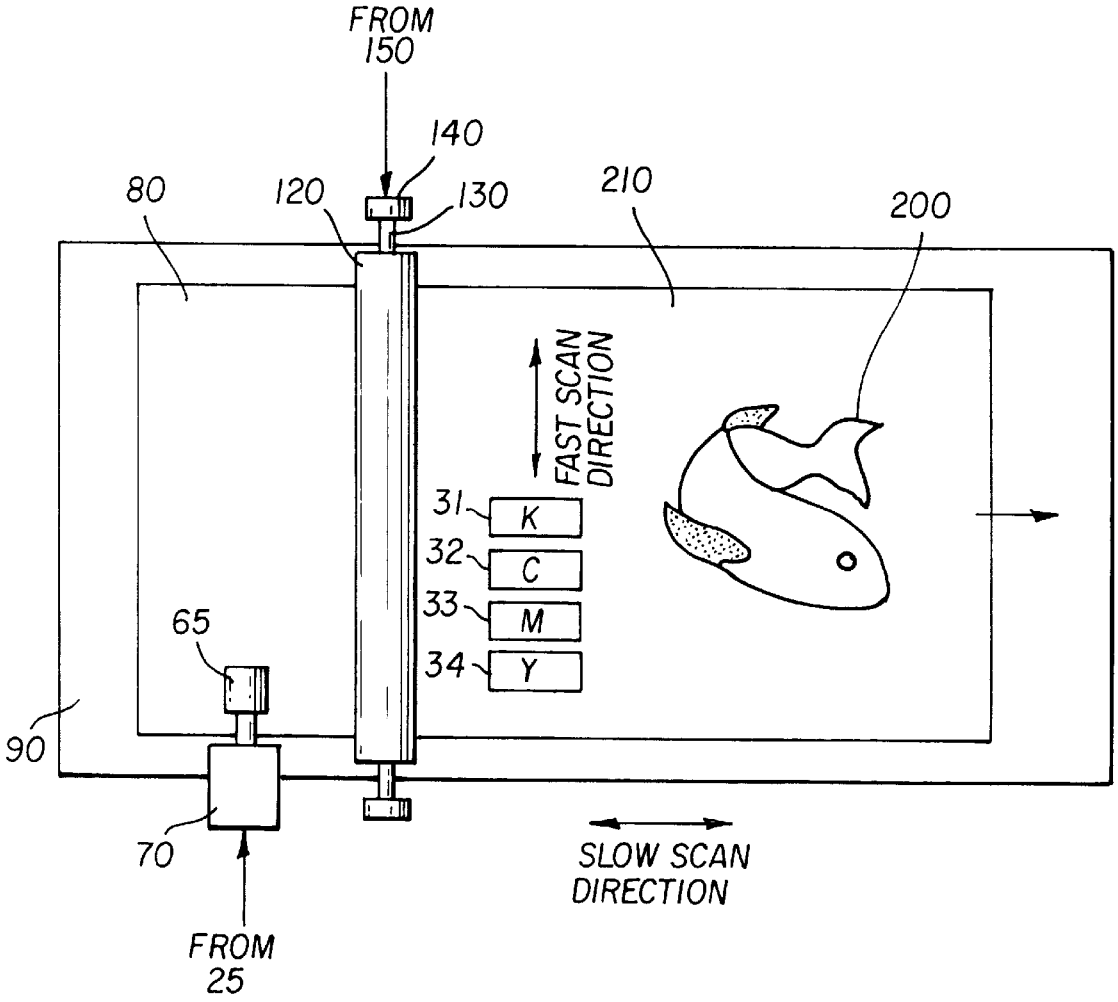
FIG. 2 is a partial top view of the ink jet printing apparatus of FIG. 1.

A digital image is applied to the computer 20. Alternatively, the computer 20 can produce this digital image itself. The digital image is processed in the computer 20 by image processing algorithms such as tone scale conversion, color mapping and halftoning well known in the art. The computer 20 sends electrical signal according to the image data to the print head drive electronics 30 which controls the print heads 31–34 in a conventional manner. During each printing pass, the computer 20 controls the control electronics 25 to operate the receiver transport motor 70 and the print head translating motor 71. Under the control of the computer, the receiver is positioned for a line of pixels of colorant to be formed and then the print head translating motor 71 moves the ink jet print heads 31–34 in a fast scan direction (shown in FIG. 1) and the print head drive electronics 30 operates the ink jet print heads 31–34 so that colorant provided from the reservoirs 40–43 is caused to be delivered as droplets to the receiving surface of the receiver 80. More particularly, the print heads 31–34 transfer ink drops 100 to the receiver 80 during each printing pass, which forms ink spots 110 on the receiver 80. After each printing pass, the receiver 80 is transported by the receiver transport motor 70 under the control of the control electronics 25 in the slow scan direction (FIG. 2). Each printed image 210 is typically formed by a plurality of printing passes.

Figure 3:
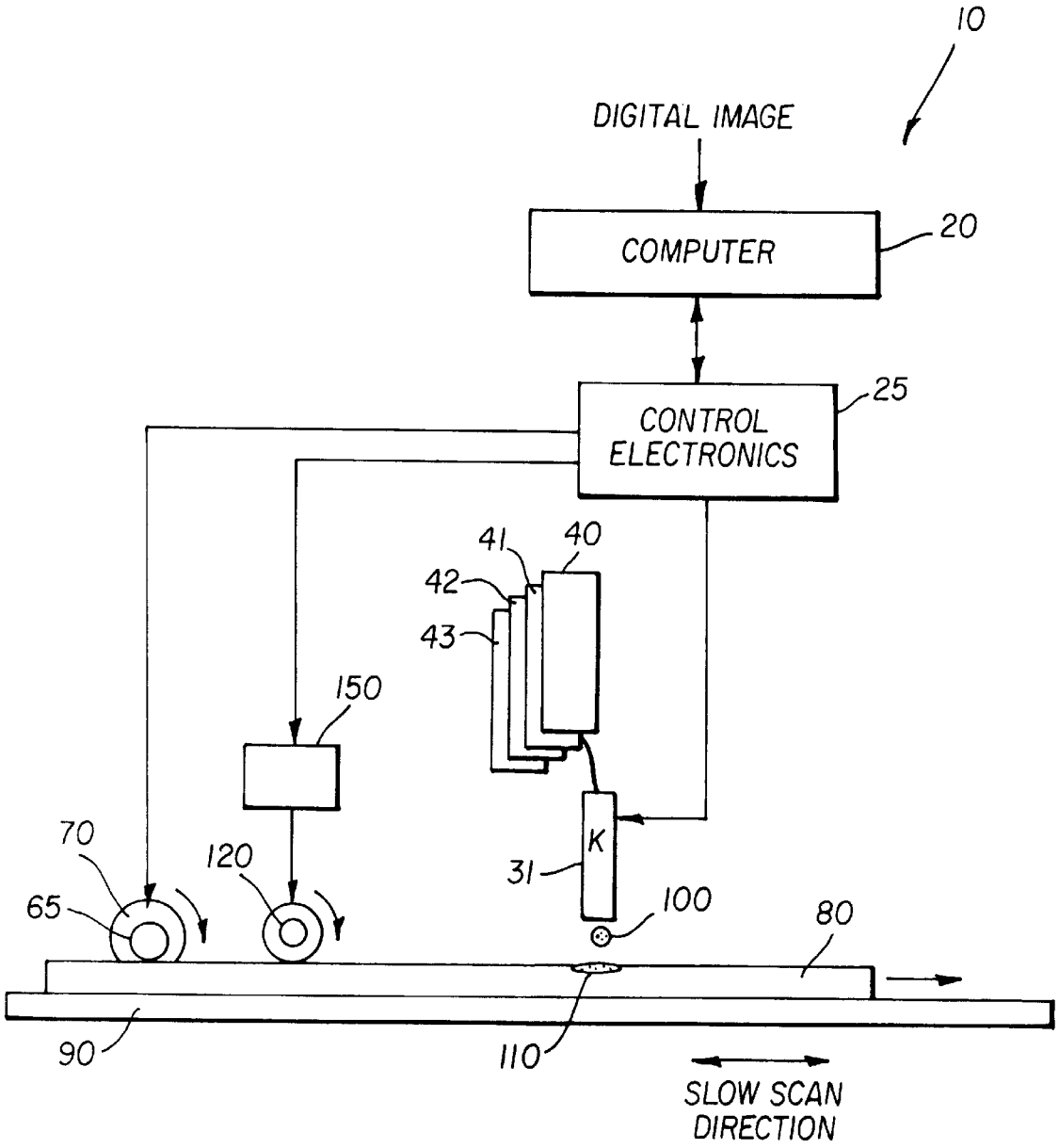
FIG. 3 is a partial side view of the ink jet printing apparatus of FIG. 1.

FIG. 2 and FIG. 3 show, respectively, partial top and side views of the ink jet printing apparatus 10 in the present invention. The receiver 80 is placed on a platen 90. The receiver 80 is transported by the receiver transport motor 70 with roller 65 under the control of control electronics 25. A fluid dispensing roller 120 containing treatment fluid is in contact with the receiver 80 prior to printing by print heads 31–34. The fluid dispensing roller 120 comprises a roller core and a support 140. The fluid dispensing roller 120 is a passive delivering device that does not require power for transferring the treatment fluid. The fluid dispensing roller 120 can be rotated by the friction force from contact with the receiver 80. Or, alternatively, the fluid dispensing roller 120 can be moved by roller transport mechanism 150 to and off from contact with the ink receiver 80.

The fluid dispensing roller 120 can exist in different forms. In one embodiment, the fluid dispensing roller 120 includes a layer of porous open-celled material wrapped around the roller core 130. The porous material absorbs the treatment fluid and releases the treatment fluid the receiver 80 when it is in contact with the receiver 80. One example of the porous materials is silicon rubber. The fluid dispensing roller 120 can also include a multiple-layered structure. A layer of porous material containing the treatment fluid is wrapped around the roller core 130. An additional outer layer is provided on the outer surface of the layer of porous materials for controlling the fluid release rate. Roller structures are described in U.S. Pat. Nos. 5,232,499 and 5,482,552. These disclosures are hereby incorporated in the present invention.

Different treatment fluids can be used for improving different aspects of printing properties. The purpose of the treatment fluid is to improve the image structure of the ink image on the receiver. This image structure includes the properties related to the ink dot formation such as dot size, dot gain, and shapes. The image structure also includes image stability and durability of the ink image. For example, ink spreading is known to affect the ink dot formation and therefore image structure on ink receiver such as a plain paper. The dot formation of ink spot 110 can be improved by using more expensive glossy paper that includes special coating layer on the top of the receiver. In accordance with the present invention, to improve the image structure on plain paper and other receivers, a treatment fluid is uniformly transferred to the receiver 80 prior to printing. For an aqueous ink formulation, a relatively hydrophobic fluid is used in the fluid dispensing roller 120. The dot gain and feathering of the ink dots are significantly reduced. This embodiment of the present invention improves the printing image structure for a wide range of receiver types. For a desired image structure, the receiver cost can be reduced.

In accordance with the present invention, the image structure can also be improved by fixing the colorant in the inks to the receivers. The fixing of the colorant involves mordanting or reacting the colorants to the receiver with the assistance of the treatment fluid. The composition and the treatment fluid, the ink and the receiver are designed for optimizing the fixing of the colorant in the receiver. Before printing, the fluid dispensing roller 120 transfers a treatment fluid containing a polymers and binder material to the receiver 120. The ink spots 110 are then placed by print heads 31–34 within the area 200 of the receiver 80 where the treatment fluid is transferred (FIG. 2). The binder material in the treatment fluid helps to bind (and fix) the colorant (dyes or pigment) in the ink to the receiver substrate. It can be desirable to select the polymers in the treatment fluid to have opposite charge to the dyes or pigment in the ink. The treatment fluid and ink formulations and receiver compositions are exemplified in U.S. Pat. No. 5,640,187 and European Patent EP 776,950 A2, which are incorporated by reference herein. Another example of reactive ink jets is disclosed in U.S. Pat. No. 4,694,302, which is also incorporated by reference.

The inks in accordance with in the present invention can include dyes or pigments. The ink colors typically will be yellow, magenta, cyan, black, red, green, blue, and other colors. Several ink densities can also be used for each color. The examples of the inks are found is U.S. Pat. No. 5,611,847, as well as the following commonly assigned U.S. Pat. Nos. 5,679,139; 5,679,141; 5,679,142; 5,698,018; and U.S. patent application Ser. No. 08/764,379; the disclosures of which are incorporated by reference herein. Colorants such as the Ciba Geigy Unisperse Rubine 4BA-PA, Unisperse Yellow RT-PA, and Unisperse Blue GT-PA can also be used in the inks of the present invention.

Although the above examples show that a receiver is treated before an image is formed on the receiver, it is understood that the present invention is also compatible with treatment of a receiver after an image if formed on the receiver.

An important feature of the present invention is that it does not require powering the fluid dispensing roller during the receiver treatment. In addition, the treatment fluid transfer to the receiver 80 does not require active motion such as thermal and mechanical ejection of treatment fluid drops in the prior art. It is therefore is not subject to the electrical and mechanical failure mechanisms that exist in the prior art techniques.

The invention has been described in detail with particular reference to certain preferred embodiments thereof, but it will be understood that variations and modifications can be effected within the spirit and scope of the invention.

PARTS LIST

10 ink jet printing apparatus
20 computer
25 control electronics
30 print head drive electronics
31 ink jet print head
32 ink jet print head
33 ink jet print head
34 ink jet print head
40 ink reservoir
41 ink reservoir
42 ink reservoir
43 ink reservoir
45 holder
56 belt
65 roller
70 receiver transport motor
71 print head translating motor
80 ink receiver
90 platen
100 ink drop
110 inkspot
120 fluid dispensing roller
130 roller core
140 roller support
150 roller transport mechanism
200 treated area
210 printed image

What is claimed is:

1. Apparatus for forming a colorant image with improved image structure on a receiver in response to a digital image, comprising:

a) print head means responsive to the digital image for transferring colorant to the receiver;

b) passive fluid delivering means for delivering treatment fluid to the receiver, the treatment fluid being selected to improve image structure wherein the passive delivering means includes a roller having a layer for holding the treatment fluid and applying the treatment fluid to the receiver; and c) means for providing relative movement between the receiver and the print head means and the passive fluid delivery means so that colorant is transferred to the receiver to provide the colorant image corresponding to the digital image on the receiver which is acted upon by the treatment fluid to provide an improved image structure.

2. The apparatus of claim 1 wherein the roller has at least two layers with an inner portion for holding the treatment fluid and outer layer for controlling the release rate of the treatment fluid and applying the treatment fluid to the receiver.

3. The apparatus of claim 1 wherein the treatment fluid is delivered to the receiver prior to the transfer of colorant to the receiver by the print head means.

4. The apparatus of claim 1 wherein the treatment fluid is delivered to the receiver after the transfer of colorant to the receiver by the print head means.

5. The apparatus of claim 1 wherein the print head means include an ink jet print head having at least three separate colorants including cyan, magenta, and yellow inks.

* * * * *